US005836558A

United States Patent [19]

Kulp et al.

[11] Patent Number: 5,836,558

[45] **Date of Patent: *Nov. 17, 1998**

[54] ADJUSTABLE SIGN MOUNTING BRACKETS

[75] Inventors: Jack H. Kulp, San Juan Capistrano, Calif.; John D. McKenney, Arroyo Seco, N. Mex.

[73] Assignee: Traffix Devices, San Clemente, Calif.

[ * ] Notice: The term of this patent shall not extend beyond the expiration date of Pat. No. 5,624,092.

[21] Appl. No.: 696,568

[22] Filed: Aug. 16, 1996

Related U.S. Application Data

[63] Continuation of Ser. No. 291,121, Aug. 16, 1994, Pat. No. 5,624,092.

[51] Int. Cl.[6] ..... A47B 96/06

[52] U.S. Cl. ..... 248/218.4; 248/219.3; 248/219.1; 40/612

[58] Field of Search ..... 248/218.4, 219.1, 248/219.4, 488; 40/606, 607, 612

[56] References Cited

U.S. PATENT DOCUMENTS

| | | | |
|---|---|---|---|
| 1,188,935 | 6/1916 | Heagany et al. | 248/488 |
| 1,854,478 | 4/1932 | Meyers . | |
| 3,638,894 | 2/1972 | Leutenegger | 248/125 |
| 3,737,958 | 6/1973 | Sharaf | 248/218.4 |
| 3,950,874 | 4/1976 | Diggs | 40/606 |
| 4,288,053 | 9/1981 | Sarkisian | 248/218.4 |
| 4,341,029 | 7/1982 | Heard | 40/607 |
| 4,433,935 | 2/1984 | Main et al. | 248/125 |
| 4,490,934 | 1/1985 | Knapp | 40/606 |
| 4,544,125 | 10/1985 | Seely | 248/624 |
| 5,181,335 | 1/1993 | Todd | 248/125 |

*Primary Examiner*—Leslie A. Braun
*Assistant Examiner*—Anita M. King
*Attorney, Agent, or Firm*—Donald E. Stout

[57] ABSTRACT

An adjustable bracket is disclosed for use in mounting a display sign, equipment, or the like on the post of a support stand, which is quick and easy to use, requires no tools, is easy to fabricate, and is adaptable to posts of different sizes and shapes. When installed, it is adapted to firmly grip the post along three lines of contact, thereby firmly securing the bracket at a predetermined location. An improved flexible sign receiving portion for such a bracket is also disclosed, which permits a flexible sign to be installed therein in a single motion, and provides a secure attachment of the sign to the sign stand, even in adverse conditions.

25 Claims, 3 Drawing Sheets

ADJUSTABLE SIGN MOUNTING BRACKETS

This is a continuation of application Ser. No. 08/291,121 filed Aug. 16, 1994, now U.S. Pat. No. 5,624,092.

BACKGROUND OF THE INVENTION

This application relates to signs and message display devices, and more particularly to adjustable brackets for attaching such signs to support stands for display to the public.

There are numerous sign stands and message display devices known in the prior art which are used for displaying various signs and messages. Often, the signs are large and heavy or are positioned outside, requiring relatively strong and durable sign mounting brackets. When adjustable brackets are used for displaying signs of various shapes and sizes, and the signs are changed frequently, the mounting brackets are usually bulky, difficult to position and operate, and often require tools to tighten them or loosen them from the sign stand post.

Often, such signs are utilized in construction-type applications where portable highway and construction related signs are presented for view by passing motorists. Signs used in the construction field may be of the rigid type, constructed of metal, plywood, or the like, or may be of the flexible type, constructed of fabric or plastic and designed to roll up for transport and storage when not in use. The signs may be of any shape, such as diamond, square, rectangular, or circular, and may be of varying sizes, depending upon the distance from which the signs must be viewed.

Whether a sign is of the flexible or rigid type, the stand upon which it is mounted usually comprises a standard type base, often having a yieldable feature comprising one or more coil springs, which permits the sign to deflect in high wind conditions and return to an upright position, and a sign post extending upwardly from the base. The sign posts used presently have various cross-sectional sizes and are typically square, though other shapes may occasionally be used. They are often telescopic in nature, being of different sizes at different vertical locations. The present invention is adaptable to function in conjunction with any conventional sign post.

For rigid signs, several different types of adjustable mounting brackets are available in the prior art. One such bracket is disclosed in U.S. Pat. No. 4,288,053 to Sarkisian, and includes a securing means comprised of a U-shaped portion within which is an adjustable gripping plate, as well as a sign holding means, which is comprised of a C-shaped portion adapted to receive a wide variety of sizes and shapes of signs. A backing plate connects the C-shaped portion to the U-shaped portion. To attach the bracket to a sign post, the U-shaped portion is slipped over the post and moved vertically to the desired position Then, the gripping plate is tightened by rotating a bent threaded handle, which is attached to the gripping plate through a hole which has been enlarged or peened over to provide a secure but loose fit, until the plate firmly contacts the post along two lines of force. To install a sign, two brackets are utilized, which are inversely oriented The upper bracket, installed facing downwardly, serves to receive an upper edge or corner of the sign, while the lower bracket, installed facing upwardly, functions to receive a lower edge or corner of the sign.

While the bracket disclosed by Sarkisian functions well, it is not as versatile as would be desirable, and is somewhat difficult to fabricate because of the necessity of attaching the gripping plate to the threaded handle from within the confines of the U-shaped bracket, through an access hole in the backing plate. Because the sign post must fit inside the U-shaped bracket, there is an upper limit on the post cross-section which can be accommodated, unless a larger bracket is fabricated. Additionally, the gripping plate grips the post along only two lines of force, which sometimes results in a less firm, sloppier grip than would be ideal.

Another type of prior art adjustable bracket for a rigid sign comprises a pair of plates which are bolted together and are adapted to receive an edge of the sign therebetween. Initially, the plates are separated by loosening the bolts, until the spacing between the plates is sufficient to accommodate the thickness of the sign to be displayed. Then, the bolts are tightened to clamp the plates against both sides of the sign to secure it. A U-shaped bracket, similar to that disclosed by Sarkisian, is welded to one of the sign receiving plates for installation about a sign post, and a fastener is adapted to be threaded into and out of the U-shaped enclosure to engage and disengage from the sign post, as desired. In this design, the end of the threaded fastener engages the sign post directly, rather than using a gripping plate, which simplifies fabrication of the bracket. However, the result is a single point contact with the post, and thus an inferior installation, subject to slippage. Furthermore, the bracket is cumbersome to manipulate when installing and removing a display sign, because of the number of threaded fasteners which must be manipulated, both to mount the bracket on the sign post, and to adapt the bracket to receive the sign.

Several different types of brackets are currently available for flexible, roll-up signs as well. Because of their lack of rigidity, flexible signs are typically mounted on a frame consisting of crossed horizontal and vertical battens, which are usually pultrusions of fiberglass or similar material. The battens may be of various sizes, depending upon the size of the sign, but the horizontal batten typically has a standard width of 1¼ inches and a thickness of 3/16 inches or less. Whereas for rigid signs two adjustable brackets are typically used, one each at the bottom and top edges of the sign, for a flexible sign only one is needed.

One prior art adjustable mounting bracket for a flexible sign comprises an integral one-piece unit having a post mounting portion comprising a square tube which is adapted to slide over a square post, and a pin which is adapted to be received by aligned holes in both the tube and the post, to hold the bracket in a predetermined position. Extending forwardly from the post mounting portion is a sign receiving portion, comprising a pair of arms each having a slot, the two slots together being adapted to receive the sign's horizontal batten. The sign receiving portion further includes a pair of upper flanges which extend forwardly from the post mounting portion, each having a hole therethrough A pivot shaft extends through both holes. About the pivot shaft is pivotally mounted a latching member, which includes an upper frontal piece and two downwardly extending latching elements. The frontal piece comprises side walls which surround the upper flanges, and through which the pivot shaft also extends. Outside of the sidewalls, the pivot shaft is riveted or otherwise permanently bonded to hold it in place. The latching member is spring-biased to a forward pivoted position. To install a sign therein, the latching elements are pivoted rearwardly to expose the batten receiving slots, and held there manually against the spring bias. Then, the horizontal batten of the sign frame is inserted completely into the two receiving slots, following which the latching member is released. The bias spring pivots the latching member forwardly, so that the latching elements each block the upper open end of their corresponding receiving slots, thereby securing the batten in position.

This bracket functions adequately to secure a flexible sign, but is awkward to manipulate and not very adaptable to different types of signs and sign posts. Because of the configuration of the post mounting portion, it is really only suitable for a square post, having just a narrow range of cross-sectional sizes. Furthermore, the sign receiving portion is awkward and difficult to operate, requiring one to manually pivot the latching member rearwardly and hold it there, with one hand, against a strong spring bias, while using the other hand to manipulate the sign's horizontal batten into the two corresponding receiving slots.

What is needed, therefore, is an improved adjustable mounting portion for attaching a sign, equipment, or the like to a support stand, as well as an improved device for receiving and securing a flexible, roll-up sign or the like. Ideally, the adjustable mounting portion should be easy to operate and fabricate, should provide a secure attachment to any conventional post configuration, and should be adaptable to receiving mechanisms for both rigid and flexible signs. The flexible sign receiving mechanism should be simple and quick to manipulate in the field, by one person, and should be capable of positively securing the sign in position, in any reasonable environmental condition.

SUMMARY OF THE INVENTION

The present invention solves the aforementioned problems of the prior art by providing an adjustable bracket which may be used to mount a display sign, equipment, or the like on the post of a support stand, is quick and easy to use, requiring no tools, is easy to fabricate, and is adaptable to posts of different sizes and shapes, though it is particularly suited to square posts. When installed, it is adapted to firmly grip the post along three lines of contact, thereby securing the bracket at a predetermined location on the post better than any prior art bracket of which Applicants are aware. Additionally, the invention provides an improved flexible sign receiving portion which permits a flexible sign to be installed therein in a single continuous motion, and provides a secure attachment of the sign to the sign stand, even in adverse conditions.

More specifically, an adjustable bracket is provided for mounting a display sign or the like (such as equipment) on a post, which bracket is adapted for removable installation on the post. The bracket comprises a first surface adapted to abut the post along a first line of contact and a second surface adapted to abut the post along a second line of contact. Advantageously, a third surface is adapted to translate through a range of positions when the bracket is installed on the post, ranging from a position wherein it does not contact the post, to a position wherein it firmly abuts the post along a third line of contact which lies at an acute angle with respect to each of the first and second lines of contact. When the third surface does not contact the post, or only loosely abuts the post along the third line of contact, the bracket may be moved vertically along the post or removed therefrom, and when the third surface is adjusted to more firmly abut the post, the bracket is fixed on the post at a predetermined vertical location. Because the bracket abuts the post along three distinct lines of contact, rather than the more customary one or two, a more positive grip of the post is achieved than is customary using prior art brackets.

In another aspect of the invention, an adjustable bracket is provided for mounting a display sign or the like on a post, wherein the bracket is adapted for removable installation on the post. The bracket comprises a first surface, a second surface, and a third surface. The three surfaces together are adapted to substantially surround the post when the bracket is installed thereon, with the first surface being adapted to abut the post along a first line of contact, and the second surface being adapted to abut the post along a second line of contact. The third surface is adapted to translate through a range of positions when the bracket is installed on the post, from a position where it does not contact the post, or only loosely abuts the post along a third line of contact, to a position wherein it firmly abuts the post along the third line of contact. When the third surface does not contact the post, or only loosely contacts the post, the bracket may be moved vertically along the post or removed therefrom, and when the third surface is adjusted to more firmly abut the post, the bracket is fixed at a predetermined vertical location thereon.

In yet another aspect of the invention, an adjustable bracket is provided for mounting a flexible display sign on a post, wherein the display sign is mounted on a frame comprised of a vertical batten and a crosswise horizontal batter. The bracket comprises an adjustable mounting portion for installing the bracket on the post and a sign receiving portion which is attached to the adjustable mounting portion The sign receiving portion comprises a generally U-shaped bracket having a bottom plate and a pair of upstanding members, with the upstanding members each including a receiving slot for receiving a portion of the horizontal batten. A generally U-shaped latching member having a bottom plate and a pair of upstanding latching fingers is also included in the sign receiving portion. Each latching finger corresponds to one of the receiving slots. The latching member is adapted to pivot about a pivot shaft which extends through both of the upstanding members. To attach a sign to the adjustable bracket, the latching member is pivoted rearwardly, the horizontal batten of the sign is inserted lengthwise into each of the receiving slots, and then the latching member is pivoted forwardly, so that each of the latching fingers blocks a corresponding one of the slots to securely retain the batten therein.

An important feature of this aspect of the invention is that each of the latching fingers includes a tooth having a frontal surface. The horizontal batten is adapted to engage the frontal surfaces of the latching finger teeth to pivot the latching fingers rearwardly, thereby permitting the horizontal batten to be inserted into the receiving slots. Thus, the sign can be engaged with the sign receiving portion of the bracket in one continuous fluid motion, easily accomplished by one person, by merely gripping the horizontal batten and moving it rearwardly into engagement with the latching finger frontal surfaces, with sufficient force to pivot the latching fingers rearwardly. The rearward pivoting of the latching fingers exposes the receiving slots for entry thereinto by the horizontal batten Once the horizontal batten has been inserted into the receiving slots, it is adapted to disengage from the frontal surfaces when fully seated in the slots, so that the latching fingers return to a forward position, with the teeth functioning to secure the batten in the slots.

The invention, together with additional features and advantages thereof, may best be understood by reference to the following description taken in conjunction with the accompanying illustrative drawing.

DESCRIPTION OF THE PREFERRED EMBODIMENT

Figure 1:
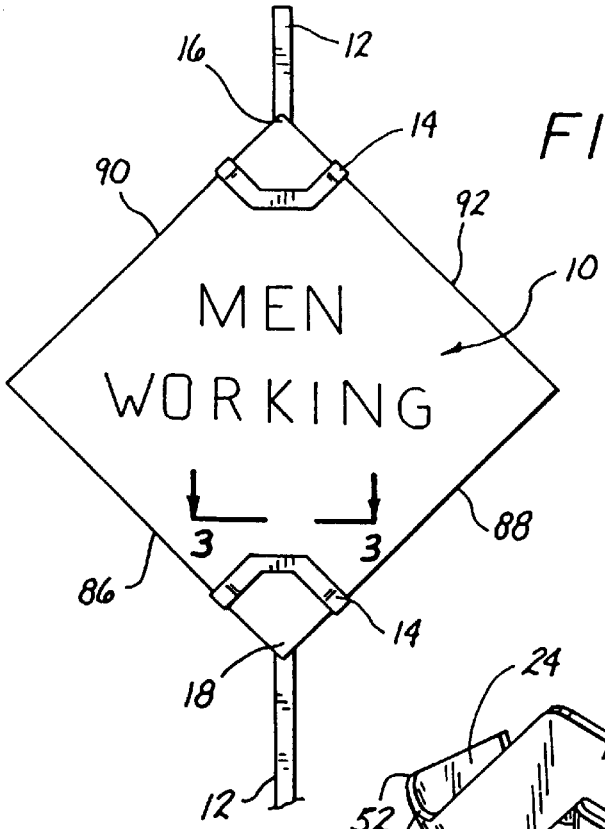
FIG. 1 is a frontal view of a rigid construction sign utilizing adjustable sign mounting brackets constructed in accordance with the present invention.

Referring now with more particularity to the drawing, FIG. 1 illustrates a relatively rigid construction sign 10, which may be fabricated of metal, wood, or other well known rigid material, and which may be used to display a construction-related legend such as "MEN WORKING", "ROAD WORK AHEAD", or the like. Though the sign 10 is preferably diamond-shaped, as illustrated, it could be any other shape commonly used in the construction field as well, including square, round, or rectangular. The sign is mounted to a post 12, which is attached at its lower end (not shown) to a base, to thereby form a stand for supporting the sign. The stand base may be of any known type, or may even be eliminated in certain configurations (i.e. a tripod). The post 12 is typically comprised of metal tubing having a square cross-section, and in the preferred embodiment is actually telescopic, having a smaller upper piece which is preferably fabricated of 1" tubing, and a larger lower piece which is preferably fabricated of 1⅛" tubing.

To mount the rigid sign 10 onto the sign stand post 12, a pair of adjustable mounting brackets 14 are employed at the upper and lower corners 16 and 18, respectively, of the sign 10, as shown in FIG. 1. These brackets 14 are shown in detail in FIGS. 2, 2A, and 3. Preferably, the two brackets illustrated in FIG. 1 are identical to one another, such that the lower bracket is reversed in orientation, i.e. with its sign-receiving pocket or space open upwardly, in order to receive the lower corner 18 of the sign. They are configured to accommodate almost any size, thickness, or shape of sign 10 and also are adapted to position the sign at various distances from the ground, as will be described more fully hereinbelow. Preferably, the brackets 14 are constructed of steel or other structural metal, though non-metallic materials, such as plastics or composites, may also be used. In some instances, it might be possible to provide a permanently mounted bracket at one of the sign corners or edges, and provide an adjustable bracket like that disclosed only at the other corner or edge.

Referring again to FIGS. 2, 2A, and 3, the adjustable brackets 14 are comprised of a sign receiving member 20 and an adjustable mounting portion 22. The sign receiving member 20 includes a pair of integral attachment tabs 24, which are adapted for attachment to a backing plate 26 of the adjustable mounting portion 22 by welding or other conventional means. The adjustable mounting portion 22 includes, besides the backing plate 26, a fixed plate 28 and an adjustable clamping plate 30. The clamping plate 30 is substantially linear, and has a pair of tangs 32 and 34 extending from its proximal end, which are bent at about a 90 degree angle with respect to the clamping plate, so that they are adapted to be interlocked with a corresponding pair of notches 36 and 38 on the backing plate 26. When the tangs 32 and 34 and the notches 36 and 38 are interlocked, such that the clamping plate 30 is removably attached to the backing plate 26, the clamping plate, which is substantially linear, extends rearwardly at an acute angle θ from the backing plate (FIG. 3). At its distal end, the clamping plate 30 includes a recessed portion 40 (FIGS. 2A and 3), which is formed and bounded by a first bend 42 and a second bend 44 at the plate edge. Within the recess 40 is a bolt hole 46 (FIG. 2A), which is preferably countersunk for reasons to be described hereinbelow.

The fixed plate 28 is fixedly attached to the backing plate 26, preferably by welding, though other conventional means of attachment may also be utilized, such that it extends rearwardly therefrom substantially orthogonally. The plate 28 comprises a linear portion 48 and is bent to also form an angled portion 50, which is oriented at approximately the same angle θ with respect to the backing plate 26 as is the clamping plate 30, such that the clamping plate 30 and the angled portion 50 of the fixed plate 28 are at least roughly parallel. The fixed plate 28 also includes a preferably square bolt hole (not specifically shown) in its angled portion 50, which is arranged to linearly correspond with the bolt hole 46 when both plates 28 and 30 are attached to the backing plate 26. The bolt hole in the fixed plate 28 is countersunk in the same manner as the bolt hole 46.

The sign receiving member 20 is preferably bent outwardly from the backing plate 26 at first and second bends 52 and 54, respectively, in order to leave a space therebetween within which a sign 10 may be positioned. The sides 56 and 58 of the receiving member are angled in a direction such that the edge of a sign of any shape directed into the sign receiving member 20 is guided downwardly further into the space, thereby holding the sign as securely as possible. For a diamond-shaped sign as illustrated in FIG. 1, the corner of the sign is the edge received into the sign receiving member. Signs of various thicknesses may be held securely and tightly in place in the bracket due to the shape of the receiving member with its angled sides. Thin 0.080 to 0.100 inch thick aluminum or other metal signs will bottom easily all the way down into the space formed between the sign receiving member 20 and the backing plate 26 by the bends 52 and 54. Thicker signs of ⅝ inch plywood or equivalent material are accommodated by the angled sides 56 and 58 and received as far into the space as possible, while still being securely retained. The remaining portions 60, 62, and 64 of the receiving member preferably form a modified "V", with portions 60 and 62 comprising the "legs" of the V and portion 64 comprising a flattened "bottom" thereof. Alternatively, however, the receiving member 20 could comprise other single piece continuous shapes, i.e. a curved configuration, or could even comprise a discontinuous configuration For example, the bottom portion 64 and perhaps the leg portions 60 and 62 could be eliminated, and the angled sides 56 and 58 (possibly including the legs 60 and 62) could comprise a pair of clips which would receive and secure the sign.

One important feature of the invention is that the backing plate 26 is configured to permit the frontal surfaces 66 of each of the attachment tabs 24 and the frontal surface 68 of the backing plate 26 to lie in substantially the same plane (best shown in FIG. 3), so that the back side of a sign 10 which is received by the member 20 rests against a substantially flush surface, and there is minimal risk that the sign will impact the ends of the tabs 24 as it slides into the receiving member 20. To accomplish this, a first rearward bend 70 in the backing plate 26 permits the portion of the backing plate frontal surface 68 which contacts the attachment tab 24 to be displaced rearwardly by a distance substantially equal to the thickness of the attachment tab 24, so that the remaining backing plate frontal surface 68 and the tab frontal surface 24 are substantially flush. A second rearward bend 72 performs the same function with respect to the other tab 24, and additionally provides space to accommodate the tangs 32 and 34 once they have been inserted into the notches 36 and 38, so that the tangs do not extend forwardly of the backing plate frontal surface 68.

To install the adjustable bracket 14 on a square sign post 12, the backing plate 26 and fixed plate 28 are positioned to lie in flush abutting fashion along two sides 74 and 76, respectively of the post 12. Then, the clamping plate 30 is attached to the backing plate 26 by inserting the tangs 32 and 34 into their corresponding notches 36 and 38. A carriage bolt 78 or similar fastening device, having a threaded end 79 and a head end 80, is inserted through the bolt hole in the fixed plate 28, then through the bolt hole 46 in the clamping plate 30, so that the head 80 of the carriage bolt lies flush against the fixed plate 28 and the square shoulder 81 (FIG. 2A) of the bolt is engaged in the square bolt hole therein A coil compression spring 82 is installed about the bolt threads between the two plates 28 and 30 to provide a biasing force which separates the two plates and to keep the carriage bolt head 80 engaged in the bolt hole in the fixed plate 28. Then, a large, modified wing nut 84, or equivalent fastener, is threaded onto the threaded end 79 of the bolt 78. Preferably, it is sufficiently large so that, because of its size and the fact that the compression spring 82 acts to keep the head end 80 of the carriage bolt engaged in the square bolt hole of the fixed plate 28, in an anti-rotational position, finger-tightening against the back side of the clamping plate, without the use of wrenches or other hand tools, is all that is necessary to force the clamping plate snugly against the corner 85 (FIG. 3) of the post, opposing the two sides 74 and 76. The bracket thus grips the post along three lines of contact, providing a positive and secure attachment to the post, with the biasing spring providing a counter force to the threaded wing nut to thereby even more positively engage the clamping plate against the post, and, as discussed supra, to secure the carriage bolt into its square hole in the fixed plate 28 when the wing nut 84 is loosened or tightened.

An alternative approach for installing the bracket 14 on the post 12 is to preassemble the bracket by engaging the tangs 32 and 34 of the plate 30 into the corresponding notches 36 and 38 of the plate 28. Then, the carriage bolt 78, is inserted through the bolt holes of the plates 28 and 30 so that the square shoulder 81 of the bolt is engaged in the square hole of plate 28. The compression spring 82 is installed about the bolt threads between the two plates 28 and 30. Then, the wing nut 84 is loosely threaded onto the threaded end 79 of the bolt.

Once the bracket 14 has been preassembled, it may be installed onto the post 12 from either end thereof, then slid along the post to its desired position. Once properly located, the wing nut 84 is tightened, as described supra.

Another feature which ensures positive engagement of the clamping plate 30 against the post 12 is the recess 40 in the plate 30, as well as the fact that the bolt hole in plate 30 is countersunk. As the wing nut 84 is tightened, the spring 82 becomes increasingly compressed, until it approaches a solid length. Because the bolt hole in plate 30 is countersunk, the corresponding end of the spring 82 firmly seats itself within the countersunk portion of the bolt hole, so that the end spring coil cannot engage the threads on the bolt and thereby prevent the bolt from sliding through the hole as the wing nut is tightened. Additionally, the recess 40 permits the spring to compress and expand across a greater linear distance without attaining a solid length when clamped onto the post 12, which further stabilizes the spring, as well as the clamping plate.

To install and position a sign 10 on the sign post 12, it is preferred that a pair of the adjustable brackets 14 are loosely positioned on the post, in reverse orientation, as shown in FIG. 1. The lower bracket 14 is then finger-tightened using the wing nut 84 until it is snugly located on the post so that the sign will be at a desired height from the ground. Then, the lower corner 18 of the sign 10 is slid downwardly into the space between the frontal surface 68 of the backing plate 26 and the receiving member 20, until the lower sides 86 and 88 of the sign abut the sides 56 and 58 of the receiving member, respectively, and the sign is thereby prevented from descending further. Once the lower corner is secured, the upper bracket 14 is loosened by means of its wing nut 84 until it may be slid downwardly along the post a sufficient distance so that the upper corner 16 of the sign is received by the upper bracket's receiving member. When the continued descent of the bracket is prevented by the abutment of the upper sides 90 and 92 of the sign with the sides 58 and 56, respectively, of the bracket, and the wing nut 84 is tightened, installation of the sign is complete. As stated supra, any sign shape, and practically any sign thickness, ranging from ¾ inch plywood to 0.08 inch steel, or less, may be accommodated.

After installation, to change the height of the sign, one need only loosen the wing nut 84 on each bracket, and slide the brackets together upwardly or downwardly the desired distance. Similarly, to remove or install the brackets from or onto the post 12, the wing nut need only be loosened sufficiently to permit the bracket to be slid off of or onto the post.

Therefore, the inventive rigid sign adjustable bracket is an improved and versatile tool for securely positioning and holding a sign. Furthermore, because the three plate members of the bracket provide contact with the sign post 12 along three lines of force, which lie generally along the contacting surfaces of each of the three plate members, respectively, and because the clamping plate 30 is angled, the bracket easily adapts to any post within a wide range of sizes, merely by adjusting the position of the clamping plate by tightening or loosening the wing nut 84. This means that, for example, using the telescoping post 12 of the preferred embodiment, the upper bracket 14 may be positioned on the upper, smaller post section, while the lower bracket 14 may be positioned on the lower, larger post section, with no difficulty and with equal security. There is also no difficulty in mounting the bracket 14 on differently shaped posts 12, such as, for example, round posts. In such a case, each plate 26, 28, and 30 would abut the post along a tangential line of contact, resulting in a highly effective attachment of the bracket to the sign post.

Figure 4:
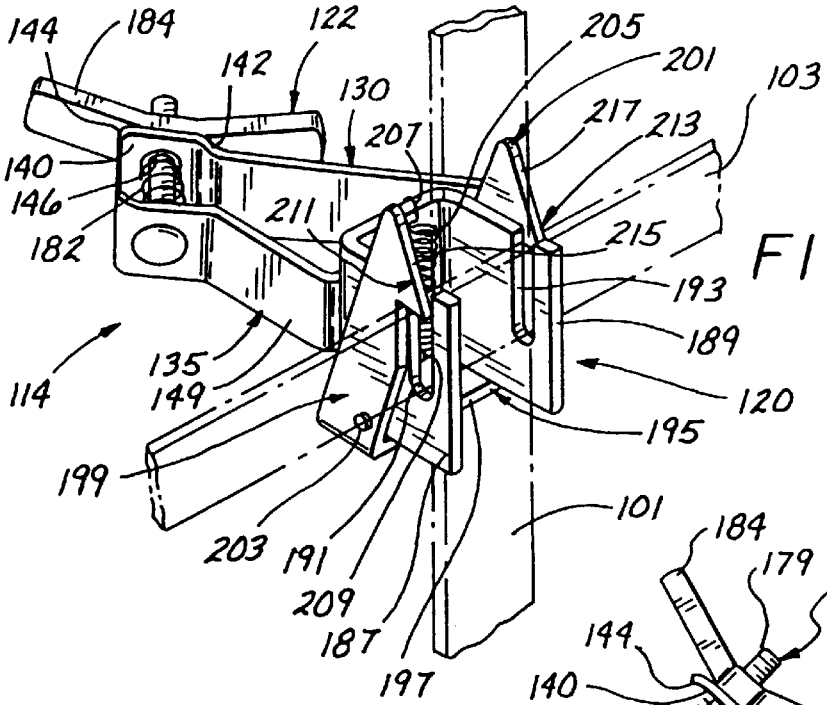
FIG. 4 is a perspective view illustrating a second embodiment of an adjustable sign mounting bracket, for mounting flexible roll-up signs.
Figure 5:
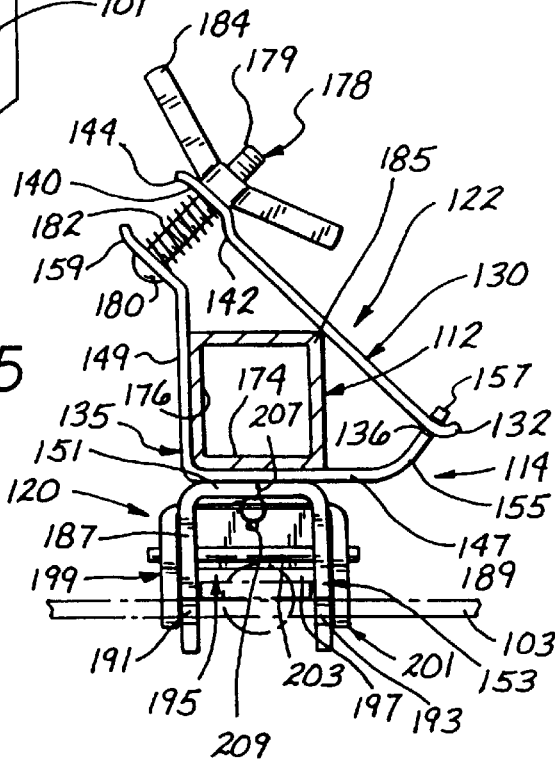
FIG. 5 is a cross-sectional view from the top of the bracket shown in FIG. 4, illustrating the sign mounting bracket in an installed position on a sign support post.
Figure 6:
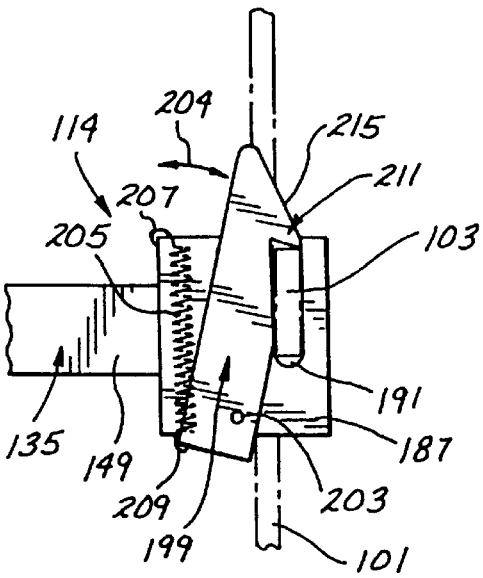
FIG. 6 is a fragmentary side view of the sign mounting bracket illustrated in FIG. 4.

Now with reference to FIGS. 4, 5, and 6, a second embodiment of an adjustable sign mounting bracket, useful for flexible roll-up signs, is illustrated. Since many of the elements in the second embodiment are similar to those in the first embodiment, those elements are designated by like reference numerals, preceded by a 1.

As discussed supra, in the Background of the Invention portion of the specification, it is often desirable to employ a temporary message display apparatus, such as a sign, which is compact and easily transportable, yet is large enough to adequately display the desired message. For example, utility workers often deploy such portable, temporary signs when required utility repairs necessitate working and/or parking a vehicle in or adjacent to a traffic lane, to alert oncoming drivers to the approaching hazard. Flexible, roll-up signs, fabricated of fabric or plastic, are often used in such instances because they are light, compact, and occupy very little storage space in the utility vehicle. They are often used for construction projects as well, particularly very short term projects such as repairing pot holes or striping traffic lanes. The standard construction for such a roll-up sign (not shown) is to attach it at its corners by known means, such as plastic corner attachment devices, or pockets, to the ends of each of two flexible frame members, or battens, 101 and 103, which are preferably constructed of pultruded glass fiber reinforced polyester plastic (i.e. polyglass) or glass reinforced plastic (GRP).

Figure 2:
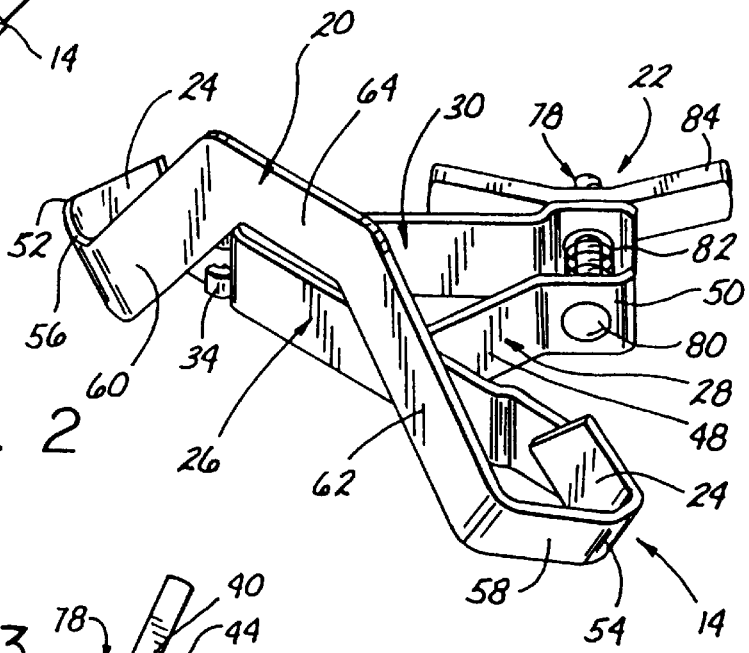
FIG. 2 is a perspective view illustrating a first embodiment of an adjustable sign mounting bracket, for mounting rigid signs like that shown in FIG. 1.
Figure 3:
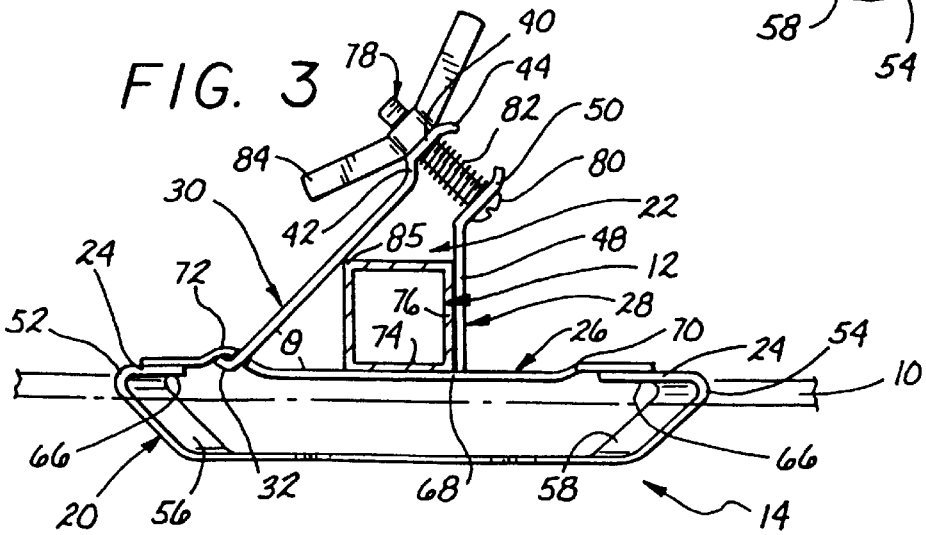
FIG. 3 is a cross-sectional view along lines 3—3 of FIG. 1, illustrating from the top a rigid sign mounting bracket like that shown in FIG. 2.
Figure 2A:
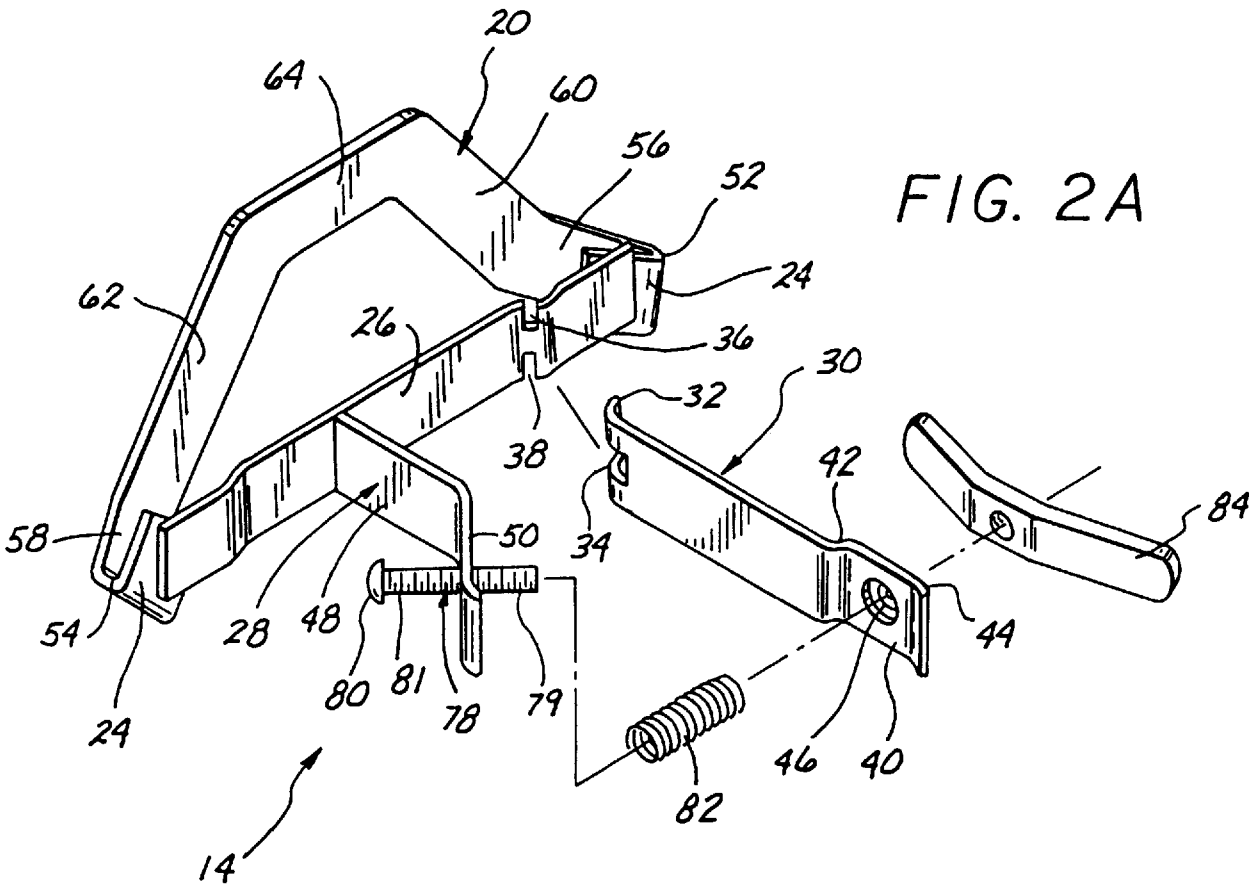
FIG. 2A is an exploded rear view in perspective of the rigid sign mounting bracket illustrated in FIG. 2.

The sign stand for a flexible roll-up sign is generally similar to that for a rigid sign of the type discussed supra with respect to the FIGS. 1–3 embodiment, in that it comprises a post 112 (FIG. 5) and a base (not shown), both of which are of known construction. The post 112 is preferably fabricated of metallic hollow square tubing, and is comprised of two telescoping segments, like post 12 of FIG. 1, though many other configurations may be utilized in conjunction with the invention. An adjustable mounting bracket 114 comprises a sign receiving member 120 and an adjustable mounting portion 122. The adjustable mounting portion 122 is similar in configuration to the adjustable mounting portion 22 of FIGS. 2 and 3, but is adapted for integration with the sign receiving member 120. Thus, the adjustable mounting portion 122 includes an adjustable clamping plate 130 (FIGS. 4 and 5) having a first tang 132 and a second tang (not shown), which are similar to tangs 32 and 34 of FIG. 2A. A fixed plate 135, having a generally L-shaped configuration, has a first notch 136 which is adapted to receive the first tang 132, and a second notch (not shown) which is adapted to receive the second tang The plate 130 further includes a recessed portion 140 (FIGS. 4 and 5), which is formed and bounded by a first bend 142 and a second bend 144 at the plate edge. Within the recess 140 is a bolt hole 146 (FIG. 4), which is preferably countersunk.

The fixed plate 135 includes a first linear portion 147 and a second linear portion 149, best seen in FIG. 5. The first linear portion 147 lies in abutting relationship with a bottom portion 151 of a U-shaped one-piece bracket 153, which comprises a part of the sign receiving member 120. It is preferably attached to the bottom portion 151 by welding, though other conventional attachment means could be employed as well. Preferably, a radiused bend 155 transitions the first linear portion 147 to an angled portion 157, in which portion the first and second notches described supra are located. The second linear portion 149 also transitions to an angled portion 159, in which is located a preferably square bolt hole (not specifically shown). This bolt hole is arranged to be in corresponding aligned relation with the first bolt hole 146.

Though the adjustable mounting portion 122 has been modified with respect to the FIG. 1 embodiment, to accommodate the different construction of the flexible roll-up sign receiving member with respect to the rigid sign receiving member, it is installed onto a sign post in a similar manner. Thus, to install the adjustable bracket 114 onto a square sign post 112, the first and second linear portions 147 and 149 of the fixed plate 135 are positioned to lie in flush abutting fashion along two sides 174 and 176, respectively of the post 112. Then, the clamping plate 130 is attached to the fixed plate 135 by inserting the first tang 132 and the second tang (not shown) into their corresponding notches, the first notch 136 and the second notch (not shown), respectively. A carriage bolt 178 or other similar fastening device, having a threaded end 179 and a head end 180, is inserted through the square bolt hole in the fixed plate 135, then through the countersunk bolt hole 146 in the clamping plate 130, so that the head 180 of the carriage bolt lies flush and engaged in an anti-rotational position against the fixed plate 135. A coil compression spring 182 is installed about the bolt threads between the two plates 130 and 135 to provide a biasing force which separates the two plates, thereby keeping the head 180 of the carriage bolt engaged in its square hole in the fixed plate 135. Then, a wing nut 184, or equivalent fastener, is threaded onto the threaded end 179 of the bolt 178. Preferably, it should be large enough so that, because of its size and the fact that the head of the bolt is held in an anti-rotational position by the spring 182, finger-tightening, without the use of wrenches or other hand tools, of the wing nut against the back side of the clamping plate 130 is all that is necessary to force the clamping plate snugly against the corner 185 opposing the two sides 174 and 176 of the sign post 112. The bracket thus grips the post along three lines of contact, as in the FIG. 1 embodiment, to provide a positive and secure attachment to the post.

Also, as in the FIG. 1 embodiment, the spring 182, as well as the fact that the bolt hole in plate 130 is countersunk, helps to ensure that the square shoulder on the bolt remains engaged with the square bolt hole in plate 135, and to force the plate 130 back against the wing nut 184. As the wing nut 184 is tightened, the spring 182 becomes increasingly compressed. Additionally, the recess 140 permits the spring to compress and expand across a greater linear distance without attaining its solid length, which further stabilizes the spring, as well as the clamping plate.

As stated supra, the sign receiving member 120 includes a U-shaped bracket 153, which comprises the bottom portion 151 and first and second upstanding segments 187 and 189, respectively. The first upstanding segment 187 includes a first receiving channel or slot 191, and the second upstanding segment 189 includes a second receiving channel or slot 193. The two slots 191 and 193 are aligned, and adapted to receive the horizontal batten 103, as will be described hereinbelow.

In surrounding relationship about the U-shaped bracket 153 is a generally U-shaped pivotable latching member 195, which has a bottom portion 197 and first and second upstanding latching fingers 199 and 201, respectively. The latching member 195 is adapted to pivot about a pivot shaft 203, as shown by the arrow 204 in FIG. 6. The pivot shaft 203 extends through aligned drilled holes in each of the first and second latching fingers 199 and 201, and through similar holes in each of the first and second upstanding segments 187 and 189, as best illustrated in FIG. 5. In order to ensure a permanent installation, the pivot shaft is preferably welded into position once it has been inserted through each of the four aligned holes. Preferably, a biasing spring 205 biases the latching member 195 in a forward position, as best illustrated in FIG. 6. The spring 205 preferably comprises a hook 207 at its upper end and a hook 209 at its lower end. The spring is removably attached to the mechanism by inserting the hook 207 into an eyelet in the bottom portion 151 of the bracket 153, and the hook 209 into an eyelet in the bottom portion 197 of the latching member 195. The latching fingers 199 and 201 include teeth 211 and 213, respectively, for a purpose to be described infra.

In contrast to the case of a rigid sign, to install and position a flexible roll-up sign on the sign post 112, only a single adjustable bracket 114 is required The bracket 114 is located on the post 112 so that the sign will be at a desired height above the ground, and then finger-tightened using the wing nut 184 until it is locked snugly onto the post, in the manner described supra. Then, the horizontal batten 103 of the sign is moved rearwardly against frontal surfaces 215 and 217 (best seen in FIG. 4) of the teeth 211 and 213, so that the latching fingers 199 and 201 are pivoted to a rearward position, against the bias of the spring 205, and held in the rearward position while the horizontal batten 103 of the sign is inserted into the slots 191 and 193, with the vertical batten 101 being located between the two upstanding members 187 and 189. Because of the unique design of the sign receiving member 120 and the latching fingers 199 and 201, this action may occur in a single fluid motion. Once the horizontal batten is fully seated in the slots 191 and 193, and no longer applies force against the teeth frontal surfaces 215 and 217, the fingers 199 and 201 are released so that they return to their forward position, such that the teeth 211 and 213 now function to secure the batten 103 within the slots 191 and 193. A this point, the sign is securely attached to the post 112 for display. After installation, to change the height of the sign, one need only follow the same procedure as in the case of the rigid sign embodiment of FIGS. 1-3, except that only the single bracket 114 need be moved along the post 112.

To remove the sign from the post 112, the fingers 199 and 201 may again be pivoted to their rearward position and held there, wile the horizontal batten 103 is lifted clear of the slots 191 and 193. Alternatively, the entire sign and bracket assembly can be removed from the post 112 by loosening the wing nut 184 until the bracket may be slid along the post and off the top or bottom thereof, or until the clamping plate 130 may be removed from the fixed plate 135 so that the bracket can be removed from the post without sliding it off one of the post ends.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. An adjustable bracket for mounting a display sign on a post, said bracket being adapted for removable installation on said post and comprising:

a first surface adapted to abut said post along a first line of contact;

a second surface joined to said first surface which is adapted to abut said post along a second line of contact; and a clamping plate comprising a substantially planar third surface having a first end which is attached to one of said first and second surfaces and a second end which is adjustable attached to the other of said first and second surfaces using an adjustable fastener, wherein the clamping plate is adapted to translate through a range of positions when said bracket is installed on said post, from a position wherein it does not contact said post, to a position wherein it firmly abuts said post along a third line of contact which lies at an acute angle with respect to each of said first and second lines of contact, the clamping plate having no other post contacting surface, so that the clamping plate is adapted to contact said post only along said third line of contact;

such that when said third surface does not contact the post or only loosely abuts the post along said third line of contact, the bracket may be moved vertically along the post or removed therefrom, and when said adjustable fastener is adjusted to cause the third surface to more firmly abut the post, the bracket is fixed at a predetermined vertical location thereon.

2. An adjustable bracket as recited in claim 1, wherein said first and second lines of contact are substantially orthogonal with respect to one another.

3. An adjustable bracket as recited in claim 1, said clamping plate first end being removably attached to said first surface, and said second end being adjustably removably attached to said second surface.

4. An adjustable bracket as recited in claim 3, wherein said clamping plate second end includes a first fastener hole therein, and said second surface includes a corresponding second fastener hole therein, said adjustable fastener further comprising a threaded fastener which includes a bolt and a nut, said bolt having a head end and a threaded end and being adapted for insertion through said first and second fastener holes, and said nut being adapted to threadedly engage said bolt at its threaded end which extends through said first fastener hole in the clamping plate, such that said nut may be tightened on said bolt to cause the clamping plate to translate in the direction of the post, with a sufficient range of motion to permit the clamping plate to firmly abut the post along said third line of contact so that the bracket may be fixed at said predetermined vertical location on the post, and such that the nut may be loosened on the bolt to cause the clamping plate to translate in a direction away from the post, whereby the nut may be loosened sufficiently to be removed from the bolt, so that the clamping plate may be disengaged from said second surface, and the bracket may be removed from the post.

5. An adjustable bracket as recited in claim 4, wherein said adjustable fastener further includes a compression spring, said spring being adapted to surround said bolt between the clamping plate and the second surface when the bolt and the nut are threadedly engaged, thereby functioning to bias said clamping plate against said nut and said bolt head end into the second fastener hole.

6. An adjustable bracket as recited in claim 5, wherein said nut comprises a wing nut, the size of the wing nut being sufficient so that, in conjunction with said compression spring, which keeps the bolt head end engaged in an anti-rotational position in the second surface fastener hole, the nut may be tightened and loosened by hand as desired, without the assistance of any tools.

7. An adjustable bracket as recited in claim 5, wherein said first fastener hole is countersunk and said spring includes first and second ends, said first spring end being adapted to seat within the countersunk hole as the nut is tightened onto the bolt.

8. An adjustable bracket as recited in claim 5, wherein said clamping plate includes a recessed portion in which said first fastener hole is located.

9. An adjustable bracket as recited in claim 1, wherein the bracket is adapted for removable installation on a square post having a first side and a second adjacent side, said first line of contact being adapted to lie substantially along the first side of said post, said second line of contact being adapted to lie substantially along the second adjacent side of the post, wherein a first corner transitions said first and second sides, which are substantially orthogonal to one another, and said third line of contact is adapted to lie across a second corner of said post which opposes said first corner.

10. An adjustable bracket as recited in claim 1, wherein said bracket further comprises a sign receiving portion.

11. An adjustable bracket as recited in claim 10, wherein said sign receiving portion is adapted to receive a rigid sign, said sign receiving portion being of a single piece continuous shape resembling a modified "V" and comprising a pair of attachment tabs for attaching said sign receiving portion to said adjustable mounting portion.

12. An adjustable bracket as recited in claim 11, wherein said sign receiving portion further comprises first and second leg portions and a bottom portion, which together create the modified "V" shape.

13. An adjustable bracket as recited in claim 12, wherein said sign receiving portion further comprises first and second side portions, which are angled outwardly from said attachment tabs in a direction adapted to provide a space into which a sign may be received, the orientation of said side portions being adapted to guide said sign further into said space so that the sign is received securely therein.

14. An adjustable bracket for mounting a display sign on a post, said bracket being adapted for removable installation on said post and comprising:

a first surface;

a second surface joined to said first surface; and a clamping plate comprising a third surface having a first end which is attached to one of said first and second surfaces and a second end which is adjustably attached to the other of said first and second surfaces;

wherein said three surfaces are adapted to form a substantially triangular configuration which substantially surrounds said post when the bracket is installed thereon, said first surface being adapted to abut said post along a first line of contact, said second surface being adapted to abut said post along a second line of contact, and said third surface being adapted to translate through a range of positions when said bracket is installed on said post, from a position where it does not contact the post, or only loosely abuts the post along a third line of contact, to a position wherein the clamping plate firmly abuts said post only along said third line of contact, such that when the third surface does not contact the post, or only loosely contacts the post, the bracket may be moved vertically along the post or removed therefrom, and when the third surface is adjusted to more firmly abut the post, the bracket is fixed at a predetermined vertical location thereon.

15. An adjustable bracket as recited in claim 14, wherein said first and second lines of contact are substantially orthogonal with respect to one another.

16. An adjustable bracket as recited in claim 14, said clamping plate first end being adapted for removable attachment to said first surface, and said clamping plate second end being adapted for adjustable removable attachment to said second surface.

17. An adjustable bracket as recited in claim 16, and further comprising a fixed plate having a first linear portion and a second linear portion, said fixed plate further including a first angled portion extending from said first linear portion and a second angled portion extending from said second linear portion, wherein said first linear portion and first angled portion comprise said first surface, and said second linear portion and second angled portion comprise said second surface.

18. An adjustable bracket as recited in claim 17, wherein said clamping plate second end includes a first fastener hole therein, and said second angled portion includes a corresponding second fastener hole therein, said bracket further comprising a threaded fastener which includes a bolt and a nut, said bolt being adapted for insertion through said first and second fastener holes, and said nut being adapted to threadedly engage the bolt at its threaded end which extends through said first fastener hole in the clamping plate, such that the nut may be tightened on the bolt to cause the clamping plate to translate in the direction of the post, with a sufficient range of motion to permit the clamping plate to firmly abut the post along said third line of contact so that the bracket may be fixed at said predetermined vertical location on the post, and such that the nut may be loosened on the bolt to cause the clamping plate to translate in a direction away from the post, whereby the nut may be loosened sufficiently to be removed from the bolt, so that the clamping plate may be disengaged from the fixed plate, and the bracket may be removed from the post.

19. An adjustable bracket as recited in claim 17, wherein said first and second linear portions are substantially orthogonal to one another.

20. An adjustable bracket as recited in claim 16, and further comprising a backing plate and a fixed plate, said fixed plate being fixedly attached to said backing plate, wherein said backing plate comprises said first surface and said fixed plate comprises said second surface.

21. An adjustable bracket as recited in claim 20, wherein said clamping plate second end includes a first fastener hole therein, and said fixed plate comprises a linear portion and an angled portion, said angled portion including a corresponding second fastener hole therein, said bracket further comprising a threaded fastener which includes a bolt and a nut, the bolt being adapted for insertion through the first and second fastener holes, and the nut being adapted to threadedly engage the bolt at its threaded end which extends through the first fastener hole in the clamping plate, such that the nut may be tightened on the bolt to cause the clamping plate to translate in the direction of the post, with a sufficient range of motion to permit the clamping plate to firmly abut the post along said third line of contact so that the bracket may be fixed at said predetermined vertical location on the post, and such that the nut may be loosened on the bolt to cause the clamping plate to translate in a direction away from the post, whereby the nut may be loosened sufficiently to be removed from the bolt, so that the clamping plate may be disengaged from the backing plate, and the bracket may be removed from the post.

22. An adjustable bracket as recited in claim 20, wherein said backing plate and said fixed plate are substantially orthogonal to one another.

23. A sign apparatus, comprising:

a post;

a sign;

an adjustable bracket for attaching the sign to the post, the bracket comprising a first surface, a second surface joined to said first surface, and a clamping plate comprising a third surface, the clamping plate having a first end which is attached to one of the first and second surfaces and a second end which is adjustably attached to the other of the first and second surfaces, wherein said three surfaces form a substantially triangular configuration which substantially surrounds said post when the bracket is installed thereon, said first surface abutting said post along a first line of contact, said second surface abutting said post along a second line of contact, and said third surface being capable of translating through a range of positions, from a first position where it does not contact the post, or only loosely abuts the post along a third line of contact, to a second position wherein the clamping plate firmly abuts said post only along said third line of contact, such that when the third surface does not contact the post, or only loosely contacts the post, the bracket may be moved vertically along the post or removed therefrom, and when the third surface is adjusted to more firmly abut the post, the bracket is fixed at a predetermined vertical location thereon.

24. A sign as recited in claim 23, wherein the first and second lines of contact are substantially orthogonal with respect to one another.

25. A sign as recited in claim 23, wherein said post is substantially square, having a first side and a second side, a first corner joining said two sides, and a second corner disposed in a position opposed to said first corner, said first line of contact lying substantially along the first side of said post, said second line of contact lying substantially along the second side of said post, and said third line of contact lying across said second corner.

* * * * *